US007600745B2

(12) United States Patent
Asada

(10) Patent No.: US 7,600,745 B2
(45) Date of Patent: Oct. 13, 2009

(54) RECORDING-SHEET SUPPLYING APPARATUS AND IMAGE RECORDING APPARATUS

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/147,329

(22) Filed: Jun. 26, 2008

(65) Prior Publication Data

US 2009/0001652 A1 Jan. 1, 2009

(30) Foreign Application Priority Data

Jun. 26, 2007 (JP) ..... 2007-167855

(51) Int. Cl.
*B65H 3/44* (2006.01)
*B65H 5/26* (2006.01)

(52) U.S. Cl. ..... 271/9.08; 271/9.11

(58) Field of Classification Search ..... 271/9.05, 271/9.08, 9.11, 9.13, 117, 162, 164
See application file for complete search history.

(56) References Cited

U.S. PATENT DOCUMENTS

| | | | | |
|---|---|---|---|---|
| 6,659,444 | B2 * | 12/2003 | Kawarama | 271/9.09 |
| 6,688,590 | B2 * | 2/2004 | Billings et al. | 271/9.05 |
| 6,776,405 | B2 * | 8/2004 | Eskey | 271/9.08 |
| 2006/0163796 | A1 | 7/2006 | Shiohara et al. | |
| 2007/0075477 | A1 * | 4/2007 | Shiohara | 271/9.08 |
| 2007/0145670 | A1 | 6/2007 | Asada | |

FOREIGN PATENT DOCUMENTS

| | | | |
|---|---|---|---|
| JP | 61124450 A | * | 6/1986 |
| JP | 61217440 A | * | 9/1986 |
| JP | S63-022435 A | | 1/1988 |
| JP | H11-255351 A | | 9/1999 |

(Continued)

OTHER PUBLICATIONS

Japan Patent Office; Notification of Reason for Refusal in Japanese Patent Application No. 2007-167855 (counterpart to the above-captioned U.S. patent application) mailed Apr. 15, 2009.

*Primary Examiner*—David H Bollinger
(74) *Attorney, Agent, or Firm*—Baker Botts, LLP.

(57) ABSTRACT

A recording-sheet supplying apparatus which supplies recording sheets one by one in a sheet-supply direction, including: a first sheet tray that accommodates first recording sheets; a second sheet tray disposed above the first sheet tray and configured to accommodate at least one second recording sheet; an arm provided so as to be pivotable about a pivot axis located above the second sheet tray, and so as to be in a posture in which a distal end of the arm is located downstream of the pivot axis in the sheet-supply direction; a first sheet-supply roller provided at a first portion of the arm; and a second sheet-supply roller provided at a second portion of the arm nearer to the pivot axis than the first portion, wherein where the second sheet tray is on an upstream side in the sheet-supply direction, only the first sheet-supply roller contacts an uppermost first recording sheet, and where the second sheet tray is on a downstream side in the sheet-supply direction, only the second sheet-supply roller contacts an uppermost second recording sheet.

14 Claims, 10 Drawing Sheets

FOREIGN PATENT DOCUMENTS

| | | | |
|---|---|---|---|
| JP | 2000-007175 | A | 1/2000 |
| JP | 2000233836 | A | 8/2000 |
| JP | 2002046874 | A | 2/2002 |
| JP | 2003146455 | A | 5/2003 |
| JP | 2006306619 | A | 11/2006 |
| JP | 2007169039 | A | 7/2007 |

* cited by examiner

RECORDING-SHEET SUPPLYING APPARATUS AND IMAGE RECORDING APPARATUS

CROSS REFERENCE TO RELATED APPLICATION

The present application claims priority from Japanese Patent Application No. 2007-167855, which was filed on Jun. 26, 2007, the disclosure of which is herein incorporated by reference in its entirety.

BACKGROUND OF THE INVENTION

1. Field of the Invention

The present invention relates to a recording-sheet supplying apparatus configured to supply recording sheets one by one, and relates to an image recording apparatus including the recording-sheet supplying apparatus.

2. Description of the Related Art

There is conventionally known an image recording apparatus, such as a printer and a facsimile, including a recording-sheet supplying apparatus in which a plurality of stacked recording sheets (hereinafter, may be referred to as sheets or cut sheets) are accommodated in a sheet tray, and each sheet is separated from the other sheets by a rotation of a sheet-supply roller, so as to be supplied to an image recording section from the sheet tray.

For example, Patent Document 1 (Japanese Patent Application Publication No. 2000-233836) discloses a recording-sheet supplying apparatus in which a drive shaft is disposed above a sheet tray so as to extend in a direction perpendicular to a sheet-supply direction, and in which an arm is pivotably supported on the drive shaft. In the apparatus, a free end of the arm points toward a sheet-separator portion provided at a distal end of the sheet tray. On a free end portion of the arm, there is mounted a sheet-supply roller for supplying each of sheets accommodated in the sheet tray. The arm is forced by a forcing spring such that the sheet-supply roller always contacts an uppermost one of the accommodated sheets irrespective of an amount (i.e., a height) of the sheets accommodated in the sheet tray. The sheet-supply roller is rotated by a rotational force transmitted from the drive shaft via a rotation transmission mechanism provided on the arm.

In the image recording apparatus as disclosed in the Patent Document 1, the sheet-supply roller is rotated in a predetermined direction, whereby a plurality of the sheets in the sheet tray are supplied. Then, an uppermost one of the sheets is separated from the other of the sheets when the supplied sheets pass through the sheet-separator portion.

Meanwhile, as shown in FIG. 10A, in the recording-sheet supplying apparatus, the sheet-supply roller 102 disposed at a distal end portion of the arm 100 which is pivoted about a drive shaft 101 provided at a basal end of the arm 100 always presses the uppermost sheet 103. Thus, where a relatively large amount of the sheets 103 are accommodated in the sheet tray, an angle of inclination of the arm 100 with respect to a surface of the uppermost sheet 103 (more precisely, an angle $\alpha$ between the surface of the uppermost sheet 103 and a line connecting a point at which the sheet-supply roller 102 contacts the sheet 103 and a pivot center of the arm 100) is relatively small. The angle of the inclination (i.e., the angle $\alpha$) becomes larger with decrease in the amount of the sheets 103 accommodated in the sheet tray.

The contacting pressure of the sheet-supply roller 102 with respect to the sheet 103, and an applying force of the sheet-supply roller 102 with respect to the sheet 103 vary in accordance with the angle $\alpha$ of the arm 100. That is, where the relatively large amount of the sheets 103 are accommodated in the sheet tray (where the angle $\alpha$ is relatively small), the applying force becomes relatively small, and the contacting pressure becomes lower. Thus, a no-sheet feeding, in which the sheet-supply roller 102 supplies no sheet 103 during its operation even though at least one of the sheet 103 is accommodated in the sheet tray, is more likely to occur. In contrast, where the relatively small amount of the sheets 103 are accommodated in the sheet tray (where the angle $\alpha$ is relatively large), the applying force becomes relatively large, and the contacting pressure becomes higher. Thus, a multi-sheets feeding of the sheets 103 is more likely to occur.

To solve the above-described problems, in the image recording apparatus as disclosed in Patent Document 1, a downstream end portion of a bottom plate of the sheet tray which plate is disposed substantially horizontally is raised so as to be nearer to the sheet-separator portion. However, a mechanism for raising the downstream end portion of the bottom plate is disposed between a main body of the image recording apparatus and the bottom plate of the sheet tray, thereby complicating a structure of the image recording apparatus and requiring a relatively large space. As a result, the image recording apparatus is unfortunately upsized.

On the other hand, as disclosed in Patent Document 2 (Japanese Patent Application Publication No. 2006-306619) for example, an image recording apparatus of a recent type is configured, in order to lower a height thereof, such that an auxiliary sheet tray (a second sheet tray) configured to accommodate small-sized sheets (e.g., post cards) in a state in which the sheets are stacked on each other is provided above a main sheet tray (a first sheet tray) configured to accommodate recording sheets (e.g., plain sheets) in a state in which the recording sheets are stacked on each other, and such that the auxiliary sheet tray can be advanced and retracted. Further, as the image recording apparatus of the recent type, there is known an image recording apparatus including a first sheet-feed device for the main sheet tray, and a second sheet-feed device for the auxiliary sheet tray. The first sheet-feed device has a first arm and a first sheet-supply roller while the second sheet-feed device has a second arm and a second sheet-supply roller. The first arm and the second arm are pivotably supported by one drive shaft.

In the image recording apparatus having the two arms, the auxiliary sheet tray is disposed such that a bottom plate of the auxiliary sheet tray is above a surface of an uppermost one of the sheets in the main sheet tray with a prescribed vertical space in a state in which a maximum amount of the sheets are accommodated in the main sheet tray. In an image recording apparatus disclosed in Patent Document 2, the first arm is longer than the second arm such that a range of an angle of the inclination of the first arm with respect to a surface of an uppermost one of the sheets in the main sheet tray and a range of an angle of the inclination of the second arm with respect to a surface of an uppermost one of the sheets in the auxiliary sheet tray are almost the same, that is, such that a range of an angle between the surface of the uppermost sheet in the main sheet tray and a line connecting a pivot center of the first arm and a point at which a sheet-supply roller provided in the first arm contacts the sheet, and a range of an angle between the surface of the uppermost sheet in the auxiliary sheet tray and a line connecting a pivot center of the second arm and a point at which a sheet-supply roller provided in the second arm contacts the sheet, are almost the same.

SUMMARY OF THE INVENTION

However, in the image recording apparatus disclosed in Patent Document 2, since the first arm and the second arm can be pivoted about the drive shaft independently of each other, a cam portion needs to be formed in a side portion of each of the main sheet tray and the auxiliary sheet tray, and a cam follower also needs to be formed for each of the first arm and the second arm, such that when each sheet in the main sheet tray is supplied, the first arm can be pivoted downward while the second arm is kept above the uppermost sheet, and such that when each sheet in the auxiliary sheet tray is supplied, the first arm is kept above the uppermost sheet while the second arm can be pivoted downward.

Where the image recording apparatus is thus constructed, a drive-force-transmitting mechanism such as a gear train further needs to be provided for each of the sheet-supply rollers respectively provided on the first arm and the second arm, thereby complicating a structure of the image recording apparatus, and leading to a heavier weight thereof. Further, the first arm and the second arm are arranged in a widthwise direction of the sheets which is perpendicular to a sheet-supply direction. Similarly, the first sheet-supply roller and the second sheet-supply roller are also arranged in the widthwise direction of the sheets. Thus, for example, if the first sheet-supply roller is disposed so as to be symmetrical in shape with respect to a plane that includes a center line of the sheets in the main sheet tray in the widthwise direction of the sheets and that is perpendicular to a line extending in the widthwise direction, the second sheet-supply roller has to be disposed in a position which is displaced from the center line of the sheets in the auxiliary sheet tray in a widthwise direction of the sheets. As a result, there occurs a problem that when each sheet in the auxiliary sheet tray is supplied, the sheet is easily supplied obliquely This invention has been developed in view of the above-described situations, and it is a first object of the present invention to provide a recording-sheet supplying apparatus configured to stably supply sheets respectively accommodated in a first and a second sheet tray, and it is a second object of the present invention to provide an image recording apparatus including the recording-sheet supplying apparatus.

The first object indicated above may be achieved according to the present invention which provides a recording-sheet supplying apparatus configured to supply recording sheets one by one in a predetermined sheet-supply direction, comprising a first sheet tray configured to accommodate a plurality of first recording sheets in a state in which the plurality of first recording sheets are stacked on each other; a second sheet tray disposed above the first sheet tray so as to be advanced and retracted in the sheet-supply direction, and configured to accommodate at least one second recording sheet in a state in which, where the at least one second recording sheet is one, only the second recording sheet is accommodated in the second sheet tray, while where the at least one second recording sheet is plural, the second recording sheets are stacked on each other in the second sheet tray; an arm provided so as to be pivotable about a pivot axis located above the second sheet tray, and so as to be in a posture in which a distal end of the arm is located downstream of the pivot axis in the sheet-supply direction; a first sheet-supply roller provided at a first portion of the arm; and a second sheet-supply roller provided at a second portion of the arm nearer to the pivot axis than the first portion, wherein the recording-sheet supplying apparatus is configured such that, in a state in which the second sheet tray is retracted to be located on an upstream side in the sheet-supply direction, the arm is allowed to be pivoted below a height level of the second sheet tray, and the first sheet-supply roller contacts an uppermost one of the plurality of first recording sheets, whereby the plurality of first recording sheets are supplied one by one in order from the uppermost first recording sheet, and wherein the recording-sheet supplying apparatus is configured such that, in a state in which the second sheet tray is advanced to be located on a downstream side in the sheet-supply direction, the second sheet-supply roller contacts an uppermost one of the at least one second recording sheet, whereby the at least one second recording sheet is supplied one by one in order from the uppermost second recording sheet.

In the recording-sheet supplying apparatus constructed as described above, even where the recording sheets of different types from each other in e.g., sheet material, thickness, and size, are respectively accommodated in the first and the second sheet trays, a no-sheet feeding and a multi-sheets feeding are prevented for the both types of the sheets, thereby allowing a reliable and stable sheet supplying operation and realizing an improved recording quality. In particular, a back tension applied by the second sheet-supply roller to each second recording sheet becomes relatively small, whereby the quality of the recording can be improved, and the multi-sheets feeding can be prevented.

The second object indicated above may be achieved according to the present invention which provides an image recording apparatus comprising: the recording-sheet supplying apparatus for achieving the first object; and an image recording section that records an image on each of the plurality of first recording sheets and each of the at least one second recording sheet which are supplied by the recording-sheet supplying apparatus.

In the image recording apparatus constructed as described above, even where the recording sheets of different types from each other in e.g., sheet material and size, are respectively accommodated in the first sheet tray and the second sheet tray, the sheet-supply rollers can stably supply the recording sheets one by one to the image recording section, thereby realizing the image recording apparatus which can prevent the no-sheet feeding and the multi-sheets feeding of the sheets caused by the sheet-supply rollers.

BRIEF DESCRIPTION OF THE DRAWINGS

The objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Figure 1:
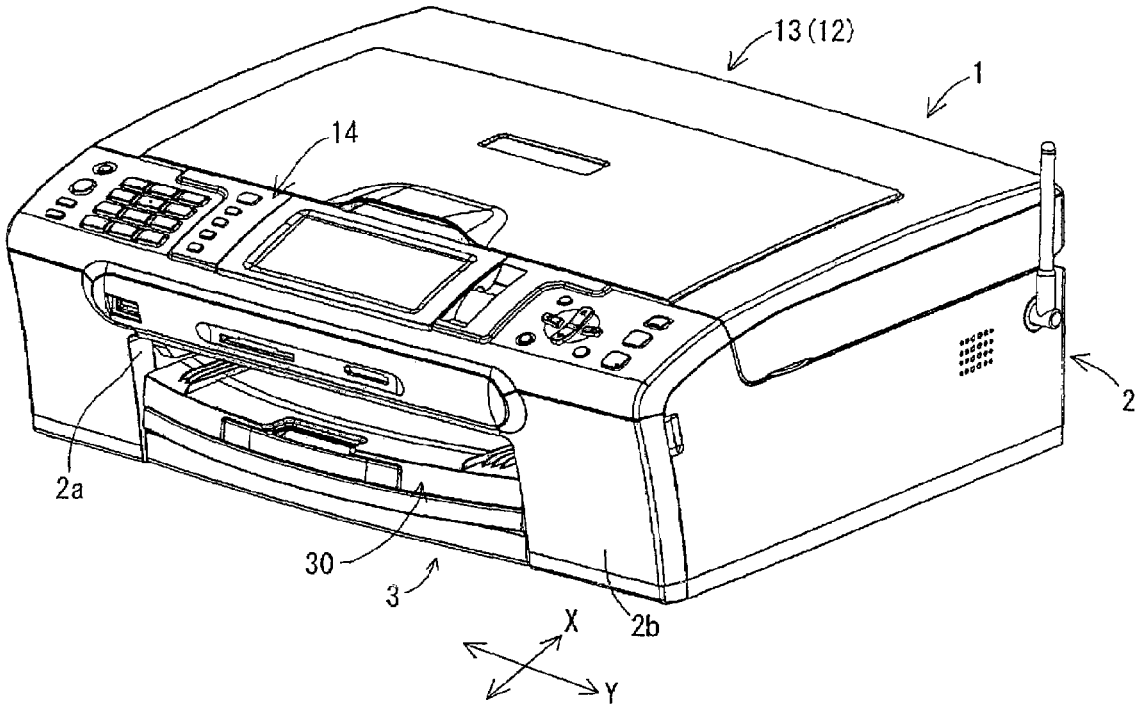
FIG. 1 is an external perspective view of an image recording apparatus.

Hereinafter, there will be described preferred embodiments of the present invention by reference to the drawings. The present invention relates to a recording sheet supplying apparatus that is employed by an image recording apparatus 1 as an present embodiment, i.e., a multi-function device (MFD) having a printing function, a copying function, a scanning function, and a facsimile function. As shown in FIG. 1, the image recording apparatus 1 includes a housing 2 that is formed by injection molding of a synthetic resin and constitutes a main frame of the image recording apparatus 1. In a bottom portion of the housing 2, there is disposed a first sheet tray 3 insertable into and removable from the housing 2 via a front opening 2*a* thereof (which is located on a left portion of FIG. 2). A second sheet tray 30 is attached to or placed on a top surface of the first sheet tray 3 so as to be advanced and retracted. In the following description, a portion, a side, or an end of the image recording apparatus 1 where the opening 2*a* is provided will be referred to as a front portion, side, or end thereof; and a portion, a side, or an end of the image recording apparatus 1 that is opposite to the front portion, side, or end thereof will be referred to as a rear portion, side, or end thereof.

In a top portion of the housing 2, there is provided an image reading device 12 for reading a document, for example, in the copying function and the facsimile function. The image reading device 12 is constructed so as to be pivotable about a shaft portion, not shown, located along a rear side of the housing 2, so that the image reading device 12 can be opened upward and closed downward. A document cover 13 configured to cover an upper surface of the image reading device 12 is attached to the image reading device 12 such that a rear end of the document cover 13 is pivotable about a rear end of the image reading device 12, so that the document cover 13 can be opened upward and closed downward.

In the top portion of the housing 2, an operational panel section 14 is provided in front of the image reading device 12. The operational panel section 14 includes various sorts of operation keys, a liquid crystal display portion, and so on. On a top surface of the image reading device 12, there is provided a glass plate on which the document can be placed with the document cover 13 being opened upward. Below the glass plate, there is provided a contact image sensor (CIS), for reading the document, which can be reciprocated along a guide shaft extending in a main scanning direction, i.e., a Y direction shown in FIGS. 1 and 2.

In FIG. 1, on a front right portion of the housing 2, there is provided a cover 2*b* for covering an ink accommodating portion, not shown, in which ink cartridges can be accommodated.

More specifically, the ink accommodating portion is configured to accommodate, in a row in the Y direction, the ink cartridges each having a rectangular box structure and respectively storing inks of four colors different from each other, namely, magenta, yellow, cyan, and black, for full color recording. The ink cartridges can be mounted on and removed from the ink accommodating portion via a front side thereof.

The inks are respectively supplied from the ink cartridges to an ink-jet recording head 4 through a plurality of ink supply tubes (four tubes in this image recording apparatus 1). It is noted that in the case where more than four sorts of inks (e.g., six or eight sorts of inks) are used, the ink accommodating portion may be modified to accommodate the corresponding number of ink cartridges, and the number of the ink supply tubes may be increased in accordance with the number of the ink cartridges.

Figure 2:
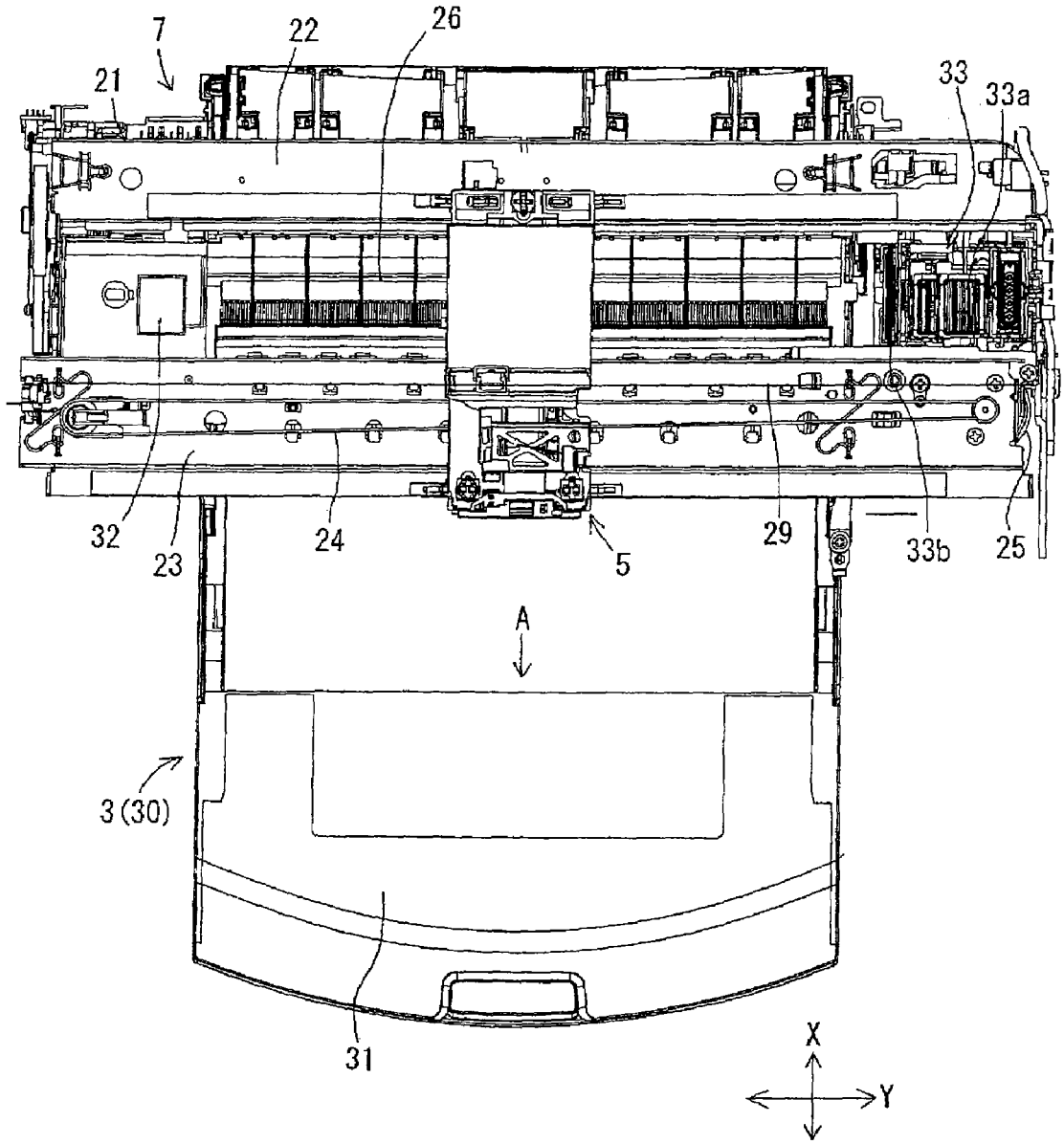
FIG. 2 is a plan view of a recording section and sheet trays.
Figure 3:
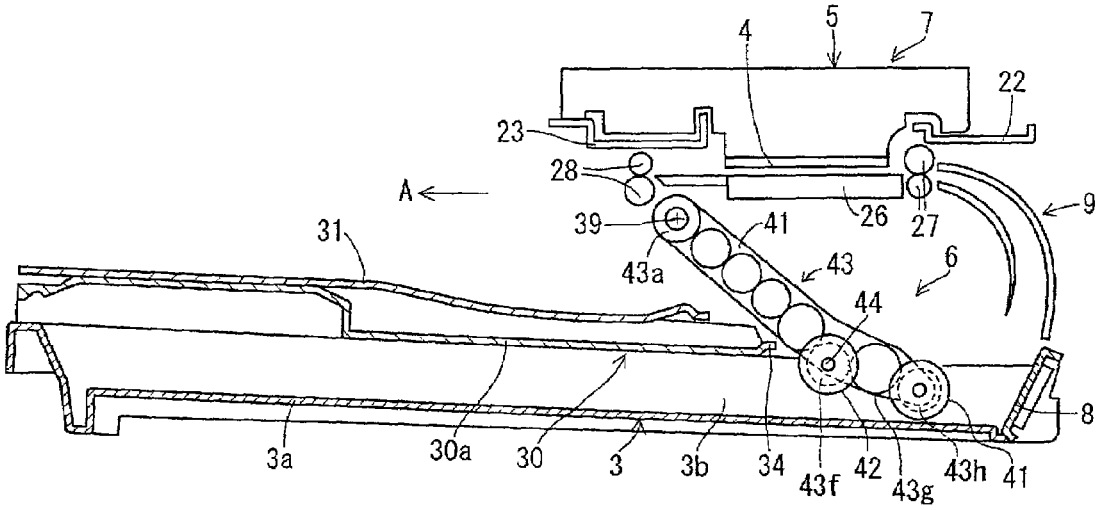
FIG. 3 is a side view showing a sheet-supply state in which a sheet-feed device supplies a recording sheet P accommodated in a first sheet tray.
Figure 4:
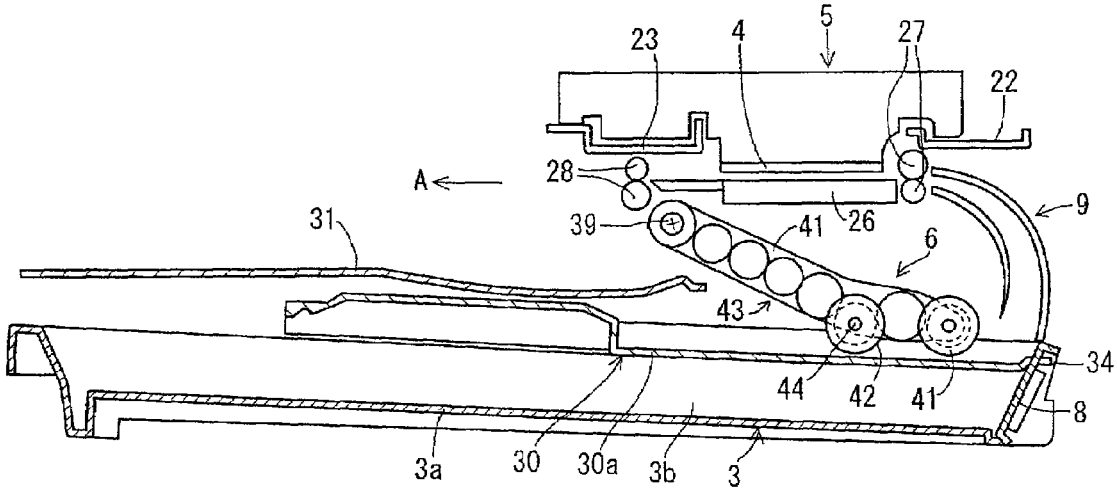
FIG. 4 is a side view showing a sheet-supply state in which the sheet-feed device supplies a recording sheet P1 accommodated in a second sheet tray.

As shown in FIGS. 2 through 4, an image recording section 7 is supported by a box-like main frame 21 opening upward and its right and left side plates. More specifically, the recording section 7 is provided, as shown in FIGS. 2 and 3, between first and second guide members 22, 23 each of which is provided by an elongated plate extending in the Y direction (i.e., in the main scanning direction). The first guide member 22 and the second guide member 23 are respectively disposed on an upstream side and a downstream side in a sheet feeding direction (indicated by arrow A). The recording section 7 includes a carriage 5 that bridges the first guide member 22 and the second guide member 23 and that can be slidably reciprocated in a state in which the carriage 5 is supported by the first guide member 22 and the second guide member 23. The recording head 4 is mounted on a lower surface of the carriage 5.

In order to reciprocate the carriage 5, a timing belt 24 is wound on pulleys disposed on an upper surface of the second guide member 23 such that the timing belt 24 extends in the main scanning direction (i.e., in the Y direction). The timing belt 24 is driven by a carriage motor 25 (shown in FIG. 2) fixed to a lower surface of the second guide member 23. The second guide member 23 is provided with a belt-like encoder strip 29 that extends in the main scanning direction and that is used for detecting a current position of the carriage 5 in the Y direction (in the main scanning direction). The encoder strip 29 is disposed such that a detection face thereof having a plurality of slits arranged at regular intervals in the Y direction vertically extends.

A flat platen 26 extends in the Y direction so as to be opposed to a lower surface of the recording head 4 mounted on the carriage 5. The platen 26 is fixed to an upper portion of a bottom plate of the main frame 21 at a position between the first and second guide members 22, 23.

As shown in FIG. 2, in the recording section 7, there are disposed the ink receiving portion 32 and the maintenance unit 33 which are disposed in respective opposite areas outside an area corresponding to a width (i.e., a length of a short side) of each sheet P (P1) as a recording medium to be fed. At a flushing position at which the recording head 4 is opposed to the ink receiving portion 32, the recording head 4 periodically ejects or flushes the inks in an image recording operation, for the purpose of preventing clogging of nozzles of the recording head 4. The ejected inks are received by the ink receiving portion 32. On the other hand, at a part of the maintenance unit 33, the carriage 5 waits for a command for starting its operation. A cap portion 33*a* of the maintenance unit 33 covers a lower surface of the recording head 4 so as to suck an arbitrarily selected one of the inks. In addition, the maintenance unit 33 carries out a recovering operation to remove air bubbles from a buffer tank, not shown, of the recording head 4, for example. It is noted that, when the carriage 5 is moved in the Y direction toward the maintenance unit 33, a cleaner (e.g., a wiper blade) 33*b* of the maintenance unit 33 wipes and cleans the lower surface (i.e., a nozzle surface) of the recording head 4.

As shown in FIGS. 3 and 4, on an upstream side of the platen 26 in the sheet feeding direction, there are provided a pair of sheet-register rollers (i.e., sheet-feed rollers) 27 for feeding the sheet P (P1) onto an upper surface of the platen 26. On a downstream side of the platen 26, there is provided a sheet-discharge roller 28 for discharging the sheet P (P1) on which an image has been recorded, onto a sheet-discharge tray 31 provided on an upper surface of the second sheet tray 30.

Next, a construction of a recording-sheet supplying apparatus will be described in detail. In this image recording apparatus 1, the recording-sheet supplying apparatus includes the first sheet tray 3 having an accommodating portion 3*b* configured to accommodate a plurality of the sheets P, each as a first sheet, in a state in which the plurality of the sheets P are stacked on each other. The sheets P accommodated in the accommodating portion 3*b* are supplied to the recording section 7 by an sheet-feed device 6 which will be described below. Further, the image recording apparatus 1 includes the second sheet tray 30 disposed above the first sheet tray 3 so as to be advanced and retracted in a sheet-supply direction, and configured to accommodate a plurality of sheets P1, each as a second sheet, which is smaller in size than the sheets P, such as a post card or an L-size photo sheet having 89 mm width and 127 mm height, for example. It is noted that the second sheet tray 30 is configured to accommodate the plurality of the sheet P1, but, as the second sheet tray 30, a tray configured to accommodate one sheet P1 may be employed. When the second sheet tray 30 is retracted in the direction indicated by the arrow A, a position of an upstream side portion of each sheet P1 in the second sheet tray 30 in the sheet-supply direction is the same as that of an upstream end portion of each sheet P in the first sheet tray 3 in the sheet-supply direction.

The first sheet tray 3 can accommodate the stack of the sheets P of selected large sizes, such as an A4 size, a letter size, and a legal size, such that a short side of each sheet P extends in the Y direction (i.e., in the main scanning direction). In this image recording apparatus 1, the first sheet tray 3 can accommodate, at the most, about one hundred plain sheets P having a height of about 10 mm.

A slant sheet-separator plate 8, as a separating member, for separating the sheets P (P1) is disposed downstream of the first sheet tray 3 and the second sheet tray 30 in the sheet-supply direction. More specifically, the slant sheet-separator plate 8 is disposed near a rear end of the first sheet tray 3 (i.e., a right-side end portion or a downstream-side end portion in the sheet-supply direction in FIGS. 3 and 4), and includes an elastic separator pad, not shown, (which is provided by a metal plate spring in this image recording apparatus 1) having a serrate shape and provided at a central part of an inner surface of the slant sheet-separator plate 8 in a widthwise direction thereof (i.e., in the Y direction). When at least two of the plurality of sheets P (P1) that include an uppermost one of the sheets P (P1) are likely to be supplied by a first sheet-supply roller 41 or a second sheet-supply roller 42 of the sheet-feed device 6 which will be described below while overlapping each other, downstream end portions of the at least two recording sheets P (P1) in the sheet-supply direction come into contact with the elastic separator pad such that the uppermost sheet P (P1) is separated from the other of the at least two of the sheets P (P1). The separated sheet P (P1) is supplied to the recording section 7 which is above the level of the first sheet tray 3 through a U-turn path (a sheet-supply path) that is defined by a feed-path-defining member 9 and curved upward and frontward. The sheet P (P1) on which the image has been recorded by the recording section 7 is discharged onto the sheet-discharge tray 31 through the opening 2*a*, with the recorded side of the sheet P (P1) being upward.

The slant sheet-separator plate 8 has a convex surface in which a central part thereof in the Y direction which is provided on the elastic separator pad projects toward the front side of the image recording apparatus 1, and side parts of the convex surface which are located on both sides of the central part thereof in the Y direction are farther from the front side of the image recording apparatus 1 than the central part. Thus, before opposite side parts, in the Y direction, of a rear end of the supplied sheet P come into contact with the slant sheet-separator plate 8, a central part, in the Y direction, of the rear end of the sheet P reliably comes into sliding contact with the elastic separator pad, so that a separating operation in which the sheet P is separated is performed.

In the accommodating portion 3*b* of the first sheet tray 3, there are provided well-known right and left side guide members (not shown) which are movable or slidable in a direction perpendicular to the sheet-supply direction so as to adjust, i.e., increase or decrease, a distance between the guide members and thereby position each sheet P at a suitable position in the Y direction. The guide members have respective racks, not shown, that are fixed to respective lower surfaces of the guide members, and the first sheet tray 3 has a pinion disposed at a center of a bottom plate 3*a* of the first sheet tray 3 in a widthwise direction. The respective racks of the guide members are meshed with the pinion so as to cause a centerline of each sheet P with respect to the Y direction to coincide with a centerline of the first sheet tray 3 with respect to the same direction. It is noted that one of the guide members has a fitting portion (not shown) which is meshed with and fitted in an engaging portion (not shown) having a serrate shape and formed on an upper surface of the bottom plate 3*a* of the first sheet tray 3, at a position at which the guide members are displaced in the widthwise direction of each sheet P.

As shown in FIG. 3, the second sheet tray 30 has a pair of engaging portions 34 that project rearwardly from a rear end of a bottom plate (i.e., a sheet placed portion) 30*a*. When the second sheet tray 30 is pushed and advanced to a sheet-supply position thereof, the engaging portions 34 are respectively engaged with a pair of positioning holes (not shown) formed in the slant sheet-separator plate 8. As a result, the second sheet tray 30 is prevented from being moved in a vertical direction and in the Y direction, and a state in which the second sheet tray 30 is located at the sheet-supply position is retained. Thus, the second sheet tray 30 can be kept at the sheet-supply position so as not to move in the vertical direction and the Y direction, whereby each sheet P1 can be reliably and stably separated and supplied.

As described above, in the second sheet tray 30, in other words, on the bottom plate (i.e., the sheet placed portion) 30*a* of the second sheet tray 30, the plurality of sheets P1 which are smaller in size than the sheets P (for example, the post card or L-size photo sheet) are accommodated in a state in which the sheets P1 are stacked on each other in the second sheet tray 30. Further, in addition to the smaller-sized sheets P1, the second sheet tray 30 can accommodate the plurality of sheets P1 whose type are different from that of the sheets P generally accommodated in the first sheet tray 3. That is, the second sheet tray 30 can accommodate sheets such as sheets specifically for an ink-jet printer, and glossy photo sheets, which are different in type from the sheets P, in a state in which the sheets P1 are stacked on each other in the second sheet tray 30. Furthermore, as well as the first sheet tray 3, the second sheet tray 30 has guide members which guide side edges of each sheet P1 that are parallel to the sheet-supply direction and which positions each sheet P1 at a suitable position in the Y direction.

Figure 6:
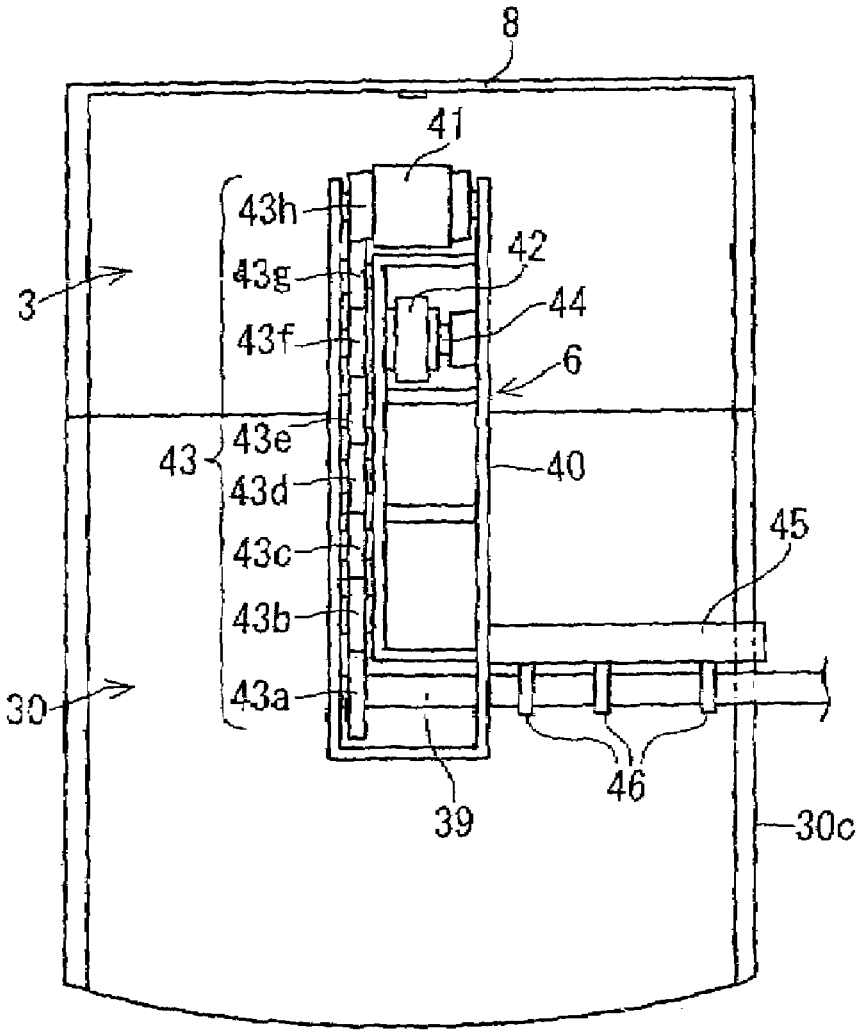
FIG. 6 is a plan view showing a sheet-feed device relating to a first embodiment.

Next, the sheet-feed device 6 will be described in detail. FIGS. 3, 4, and 6 show an image recording apparatus as a first embodiment. As shown in the figures, a rotatable drive shaft 39 located above the second sheet tray 30 and formed of a synthetic resin is rotatably supported by shaft holes respectively formed in a pair of shaft-supporting plates (not shown) and a side plate of the main frame 21 (not shown). A distal end of the drive shaft 39 is laterally inserted into a basal portion of an arm 40 of the sheet-feed device 6. The arm 40 has a frame-like shape and is formed of a synthetic resin. Thus, the arm 40 is supported by the drive shaft 39 so as to be pivotable upward and downward about an axis of the drive shaft 39 as a pivot axis of the arm 40. The first sheet-supply roller 41 is disposed at a distal end portion, as a first portion, of the arm 40 in a longitudinal direction thereof. The second sheet-supply roller 42 is disposed at a portion, as a second portion, of the arm 40 nearer to the drive shaft 39 (more specifically, the pivot axis) than the first portion. More specifically, the second sheet-supply roller 42 is disposed at an intermediate portion which is located intermediate between the drive shaft 39 (more specifically, the pivot axis) and the first sheet-supply roller 41 (i.e., the distal end portion), in the longitudinal direction of the arm 40. The arm 40 is provided so as to be in a posture in which the distal end portion of the arm 40 is located downstream of the pivot axis in the sheet-supply direction.

In the sheet-feed device 6 of the image recording apparatus as the first embodiment, the first sheet-supply roller 41 and the second sheet-supply roller 42 are arranged along the arm 40, thereby realizing a simple structure of the sheet-feed device 6. Further, the first sheet-supply roller 41 and the second sheet-supply roller 42 are rotated in the same direction by a rotation of the drive shaft 39 in one direction via a common rotation transmission system. More specifically, the first sheet-supply roller 41 and the second sheet-supply roller 42 are rotated in a direction in which the sheet P (P1) is supplied (hereinafter, may be referred to as a sheet-supply direction), or in a counterclockwise direction in FIGS. 3 and 4. In this image recording apparatus, there is provided a rotation transmission mechanism 43 including a plurality of gears for transmitting a rotation force from the drive shaft 39 to the first sheet-supply roller 41 and the second sheet-supply roller 42 such that the first sheet-supply roller 41 and the second sheet-supply roller 42 are rotated in the counterclockwise direction when the drive shaft 39 is rotated in a predetermined direction (a clockwise direction in FIGS. 3, 4, 5A, and 5B). The arm 40 is forced by a forcing means, not shown, such as a torsion spring, such that the rear portion of the sheet-feed device 6 (farther from the drive shaft 39) is always forced downward, that is, toward the bottom plate 3*a* of the first sheet tray 3, in other words, toward an uppermost one of the sheets P (P1) stacked on each other in the first sheet tray 3 or the second sheet tray 30.

Figure 5A:
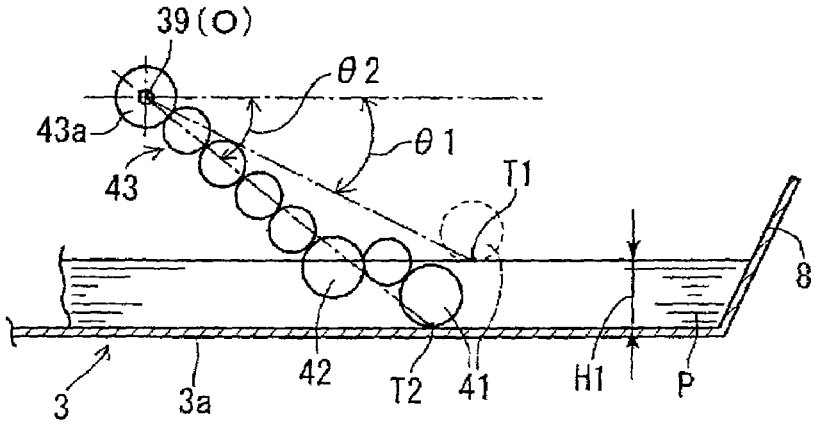
FIG. 5A is a view for explaining a sheet-supply state in which the recording sheet P is supplied by only a first sheet-supply roller.

As shown in FIGS. 3, 4, 5A, and 5B, positions of the first sheet-supply roller 41 and the second sheet-supply roller 42 respectively provided at the first portion and the second portion of the sheet-feed device 6 are set such that an axis of the second sheet-supply roller 42 is shifted downward from a line connecting the drive shaft 39 and an axis of the first sheet-supply roller 41. Thus, when the sheets P accommodated in the first sheet tray 3 are to be supplied, a state is realized in which the first sheet-supply roller 41 contacts an uppermost one of the sheets P with the second sheet tray 30 retracted to be located on an upstream side in the sheet-supply direction, while the second sheet-supply roller 41 is located above the uppermost sheet P, and such that when the sheets P1 accommodated in the second sheet tray 30 is to be supplied, a state is realized in which the second sheet-supply roller 41 contacts an uppermost one of the sheets P1 with the second sheet tray 30 advanced to be located on a downstream side in the sheet-supply direction (that is, with the second sheet tray located at the sheet-supply position), while the first sheet-supply roller 41 is located above the uppermost second recording sheet P1. Thus, as shown in FIGS. 3 and 5A, when the sheets P accommodated in the first sheet tray 3 are to be supplied one by one in order from the uppermost sheet P, the first sheet-supply roller 41 located at the distal end portion of the arm 40 is below the height level of the second sheet-supply roller 42 such that only the first sheet-supply roller 41 comes into contact with the uppermost sheet P while the second sheet-supply roller 42 does not contact the uppermost sheet P1. It is noted that, in this state, the arm 40 can be pivoted below the height level of the second sheet tray 30. In contrast, when the second sheet tray 30 is advanced toward the slant sheet-separator plate 8 to supply the sheets P1 accommodated in the second sheet tray 30 one by one in order from the uppermost sheet P1, the second sheet-supply roller 42 located at the intermediate portion of the arm 40 in the longitudinal direction thereof is below the level of the first sheet-supply roller 41 such that only the second sheet-supply roller 42 comes into contact with the uppermost sheet P1 while the first sheet-supply roller 41 does not contact the uppermost sheet P.

There will be described the construction of the rotation transmission mechanism 43 in more detail. In the image recording apparatus 1 as the first embodiment, as shown in FIGS. 3, 4, and 6, on an inner side of the frame-like arm 40, there is disposed the rotation transmission mechanism 43 including eight gears 43*a*, 43*b*, 43*c*, 43*d*, 43*e*, 43*f*, 43*g*, 43*h*, which are arranged in a row from the first gear 43*a* that rotate integrally with the drive shaft 39, to the last gear 43*h* fixed to a side face of the first sheet-supply roller 41, and each of which is meshed with corresponding adjacent one or two of the eight gears. In this image recording apparatus 1, the second sheet-supply roller 42 is fixed to a transmission shaft 44 that is rotated integrally with the sixth gear 43*f* as counted from the first gear 43*a*. Thus, the first sheet-supply roller 41 and the second sheet-supply roller 42 are rotated in the same direction. It is noted the gear 43*f* and the last gear 43*h* are not shown in FIGS. 5A and 5B.

According to the construction of the rotation transmission mechanism 43 as described above, when the drive shaft 39 is rotated in the predetermined direction (the clockwise direction in FIGS. 3, 4, 5A, and 5B), the first sheet-supply roller 41 and the second sheet-supply roller 42 are driven to be rotated in the counterclockwise direction via the rotation transmission mechanism 43.

In this image recording apparatus as the first embodiment, the first sheet-supply roller 41 includes a peripheral portion as a contact portion which contacts the uppermost sheet P, and the second sheet-supply roller 42 includes a peripheral portion as a contact portion which contacts the uppermost sheet P1. As shown in FIG. 6, the contact portion of the first sheet-supply roller 41 is symmetrical in shape with respect to a plane that includes a center line of the uppermost sheet P in a widthwise direction thereof and that is perpendicular to a line extending in the widthwise direction. The contact portion of the second sheet-supply roller 42 is symmetrical in shape with respect to a plane that includes a center line of the uppermost sheet P1 in a widthwise direction thereof and that is perpendicular to a line extending in the widthwise direction. Thus, each sheet P (P1) is prevented from being supplied obliquely, whereby each sheet P (P1) is supplied stably without a paper jam or a recording failure. Also, the contact portion of each of the cylindrical first sheet-supply roller 41 and the cylindrical second sheet-supply roller 42 is formed of a material such as a synthetic rubber (e.g., elastomer or EPDM). Each of the contact portions has a peripheral surface having parts shaved in a direction perpendicular to the sheet-supply direction.

In this image recording apparatus as the first embodiment, the diameters of the respective contact portions of the first sheet-supply roller 41 and the second sheet-supply roller 42 are the same. As a result, a circumferential velocity of the contact portion of the first sheet-supply roller 41 is the same as that of the contacting portion of the second sheet-supply roller 42. However, the rotation transmission mechanism 43 and diameters of the respective contact portions of the first sheet-supply roller 41 and the second sheet-supply roller 42 may be designed such that the circumferential velocity of the contact portion of the first sheet-supply roller 41 is higher than that of the contacting portion of the second sheet-supply roller 42. Where the image recording apparatus 1 is thus constructed the circumferential velocity of the contacting portion of the second sheet-supply roller 42 is lower, and thus a thick postcard, a glossy sheet for high quality, or the like which can be accommodated in the second sheet tray 30 can be supplied at a relatively low velocity to the U-turn feed-path-defining member 9. On the other hand, the circumferential velocity of the contacting portion of the first sheet-supply roller 41 is higher, and thus the supplying and the recording for a plain sheet accommodated in the first sheet tray 3 can be rapidly performed.

The first sheet tray 3 and the second sheet tray 30 are respectively configured to accommodate the stack of the sheets P and the sheets P1 substantially horizontally, allowing a use of a conventional sheet tray. The second sheet tray 30 is disposed above the first sheet tray 3 such that a maximum height H1 of the sheets P stacked on each other in the first sheet tray 3 is set to be greater than a maximum height H2 of the sheets P1 stacked in the second sheet tray 30. More specifically, the first sheet tray 3 can accommodate, at the most, about one hundred plain sheets, for example, while the second sheet tray 30 can accommodate, at the most, about twenty photo sheets (glossy sheets), for example. It is noted that when the second sheet tray 30 is located at its sheet-supply position, the first sheet-supply roller 41 of the sheet-feed device 6 is kept at a relatively higher position (a waiting position), so as not to contact the sheets P1 in the second sheet tray 30.

Figure 5B:
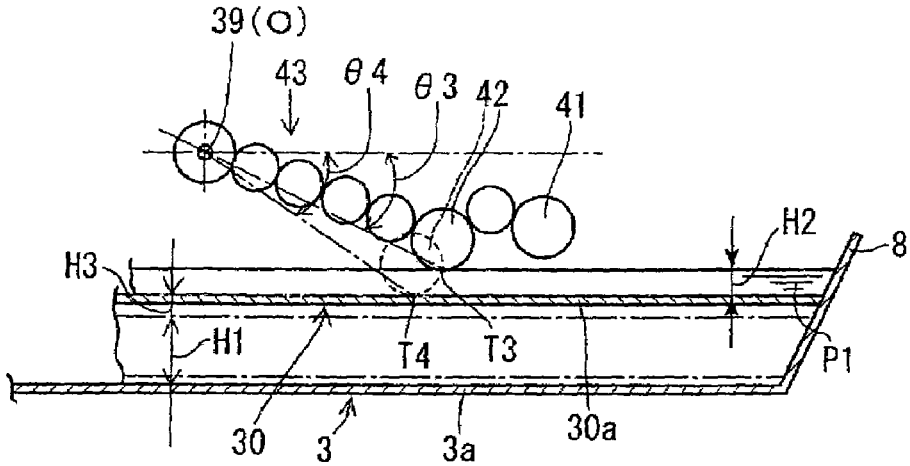
FIG. 5B is a view for explaining a sheet-supply state in which the recording sheet P1 is supplied by only a second sheet-supply roller.

Further, as shown in FIG. 5B, the second sheet tray 30 is disposed above the first sheet tray 3 such that a prescribed space H3 exists, in the vertical direction, between the uppermost sheet P and a lowermost one of the sheets P1, thereby facilitating a set of respective positions of the first sheet-supply roller 41 and the second sheet-supply roller 42 on the arm 40 such that when the sheet P accommodated in the first sheet tray 3 is supplied, only the first sheet-supply roller 41 contacts the uppermost sheet P, and such that when the sheet P1 accommodated in the second sheet tray 30 is supplied, only the second sheet-supply roller 42 contacts the uppermost sheet P1.

There will be next explained a sheet supplying operation by the sheet-feed device 6 including the arm 40 on which the first sheet-supply roller 41 and the second sheet-supply roller 42 are provided.

In FIG. 5A, in a state in which the sheets P are stacked on each other in the first sheet tray 3 at the maximum height H1, and only the first sheet-supply roller 41 contacts the sheet P (the first sheet-supply roller 41 is indicated by a broken line), a symbol "O" indicates a pivot center O of the arm 40 (i.e., the pivot axis of the drive shaft 39), a symbol "T1" indicates a point T1 at which the first sheet-supply roller 41 contacts the uppermost sheet P, and a symbol "θ1" indicates an angle θ1 between a surface of the uppermost sheet P and a line connecting the point T1 and the pivot center O. Similarly, in a state in which the one sheet P is accommodated in the first sheet tray 3, and only the first sheet-supply roller 41 contacts the sheet P, a symbol "T2" indicates a point T2 at which the first sheet-supply roller 41 contacts the sheet P, and a symbol "θ2" indicates an angle θ2 between a surface of the sheet P and a line connecting the point T2 and the pivot center O.

In FIG. 5B, in a state in which the sheets P1 are stacked on each other in the second sheet tray 30 at the maximum height H2, and only the second sheet-supply roller 42 contacts the sheet P1, a symbol "T3" indicates a point T3 at which the second sheet-supply roller 42 contacts the uppermost sheet P1, and a symbol "θ3" indicates an angle θ3 between a surface of the uppermost sheet P1 and a line connecting the point T3 and the pivot center O. Similarly, in a state in which the one sheet P1 is accommodated in the second sheet tray 30, and only the second sheet-supply roller 42 contacts the sheet P1, a symbol "T4" indicates a point T4 at which the second sheet-supply roller 42 contacts the sheet P1, and a symbol "θ4" indicates an angle θ4 between a surface of the sheet P and a line connecting the point T4 and the pivot center O.

Figure 10A:
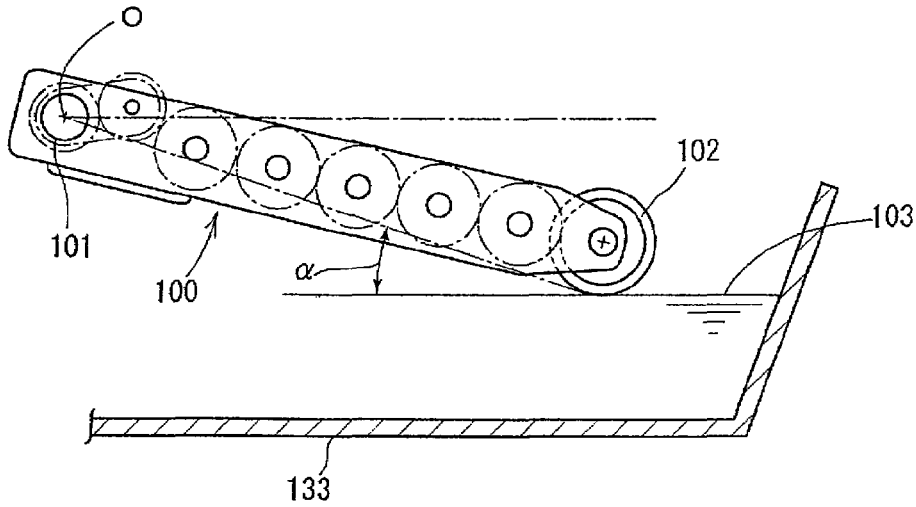
FIG. 10A is a view showing a sheet-supply state in which a conventional sheet-feed device supplies the recording sheet P accommodated in the first sheet tray.

FIG. 10A shows a conventional image recording apparatus which realizes two states: a maximum-sheets state in which a sheet tray accommodates a maximum amount of the sheets and a small-number-of-sheets state in which the sheet tray accommodates a few sheets. A contacting angle (i.e., an angle α) between a sheet-supply roller 102 and an uppermost one of sheets 103, and a contacting pressure applied to the uppermost sheet 103 contacted by the sheet-supply roller 102 vary among the two states. That is, since the contacting angle is small in the maximum-sheets state, an applying force of the sheet-supply roller 102 to the sheet 103 becomes smaller, and thus the contacting pressure becomes lower, so that a no-sheet feeding of the sheet 103 easily occurs in which the sheet-supply roller supplies no sheet 103 during the operation of the roller even though at least one of the sheets 103 is accommodated in the sheet tray. On the other hand, in the small-number-of-sheets state, the applying force becomes larger, and thus the contacting pressure becomes higher, so that a multi-sheets feeding of the sheets 103 easily occurs. In order to solve the problem, it can be considered that a force of downward pressing (hereinafter may be referred to as an initial load) of a spring to an arm 100 is set to be larger to increase the contacting pressure in the maximum-sheets state.

Figure 10B:
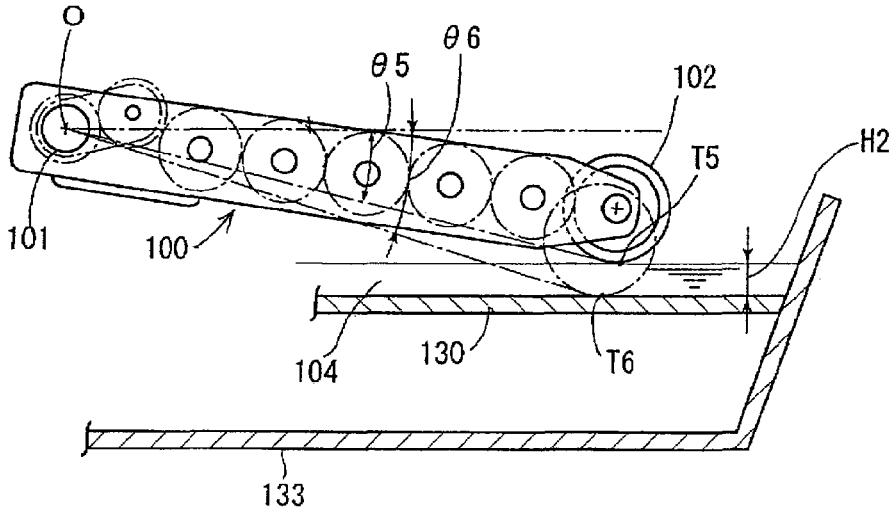
FIG. 10B is a view showing a sheet-supply state in which the conventional sheet-feed device supplies the recording sheet P1 accommodated in the second sheet tray.

Here, there will be considered a case where a second sheet tray 130 is disposed above a conventional first sheet tray 133 shown in FIG. 10. In FIG. 10B, in a state in which sheets 104 are stacked on each other in the second sheet tray 130 at the maximum height H2, and the sheet-supply roller 102 contacts the sheet 104, a symbol "T5" indicates a point T5 at which the sheet-supply roller 102 contacts an uppermost one of the sheets 104, and a symbol "θ5" indicates an angle θ5 between a surface of the uppermost sheet 104 and a line connecting the point T5 and a pivot center O of the arm 100. On the other hand, in a state in which the second sheet tray 130 accommodates one sheet 104, and the sheet-supply roller 102 contacts the sheet 104, a symbol "T6" indicates a point T6 at which the sheet-supply roller 102 contacts the sheet 104, and a symbol "θ6" indicates an angle θ6 between a surface of the sheet 104 and a line connecting the point T6 and the pivot center O. When the maximum amount of the sheets 104 are accommodated in the second sheet tray 130, the angle θ5 is extremely smaller than the angle α, and thus the no-sheet feeding cannot be prevented unless the initial load is set to be much larger. However, after a leading end portion of the sheet 104 is nipped by the sheet-feed rollers which are located immediately before a recording section, where a trailing end of the sheet 104 is held between the sheet-supply roller 102 and a next sheet 104 accommodated in the second sheet tray 130, and the increased initial load is applied to the arm 100, the following problem occurs. That is, the initial load is increased, causing a relatively large back tension to be applied to the supplied sheet 104. Further, since a degree of a curve of the supplied sheet 104 is relatively small in a path from the second sheet tray 130 to the U-turn path 9, resistance to the supplying is relatively large. Thus, where the initial load is relatively large, when the sheet 104 is to be supplied to the image recording section intermittently in a suitable distance, the sheet 104 is supplied only in a distance shorter than the suitable distance, and consequently a banding occurs on a recorded image, resulting in deterioration of quality of the image. In particular, when a high-quality recording operation is performed on the basis of e.g., photo data, the quality of the recorded image is deteriorated. Further, where stiffness of the sheets 104 is relatively lower, the multi-sheets feeding of the sheets easily occurs.

In this image recording apparatus 1 according to the present invention, the angles θ3, θ4 at which the second sheet-supply roller 42 supplies each sheet P1 in the second sheet tray 30 are respectively larger than the angles θ5, θ6 at which the conventional sheet-supply roller 102 supplies each sheet 104 in the second sheet tray 130. That is, as shown in FIGS. 5B and 10B, relations of the angles are set to be θ5<θ3, and θ6<θ4. In other words, the angle θ3 at which the second sheet-supply roller 42 is nearer to the pivot center O than the first sheet-supply roller 41 (that is, a distance between the second sheet-supply roller 42 and the pivot center O is shorter than a distance between the first sheet-supply roller 41 and the pivot center O), and the second sheet tray 30 accommodates the maximum amount of the sheet P1, is set to be much larger than the angle θ5 at which the one sheet-supply roller 102 of the one arm 100 supplies each sheet 104 in the second sheet tray 130. As a result, in this image recording apparatus 1 according to the present invention, the no-sheet feeding does not occur even where the initial load (the force of downward pressing) of the spring to the arm 40 is set to be smaller than an initial load in a conventional technique shown in FIG. 10B (that is, when the sheet-supply roller 102 of the arm 100 contacts an uppermost one of the maximum amount of the sheets P1 accommodated in the second sheet tray 30). In addition, since the initial load is not larger than necessary, the above-described back tension does not become large, so that the banding does not occur. Thus, the quality of the recording can be improved, and the multi-sheets feeding can be prevented.

When the first sheet tray 3 and the second sheet tray 30 are inserted into and removed from the bottom portion of the housing 2, the first sheet tray 3 and the second sheet tray 30 are inserted together with each other in a state in which the second sheet tray 30 is located at the rear end portion of the first sheet tray 3. In this movement, the arm 40 is automatically raised and lowered, and the first and second sheet-supply rollers 41, 42 move or climb over the slant sheet-separator plate 8, and then move downward such that the second sheet-supply roller 42 contacts the uppermost sheet P1 accommodated in the second sheet tray 30. There will be next explained a mechanism for performing these operations.

In this image recording apparatus 1, as shown in FIG. 6, a cam follower member 45 having a generally flat-plate shape and formed of a synthetic resin are provided integrally with the arm 40. The cam follower member 45 projects from the arm 40 so as to extend in a direction parallel to a direction in which the drive shaft 39 extends, and is rotatably supported by the drive shaft 39 via bearings 46. The cam follower member 45 extends to an upper side of an auxiliary cam portion, not shown, formed on an upper surface of one of side plates 30*c* of the second sheet tray 30 and having different height portions from each other.

The auxiliary cam portion is constituted by three portions: a first inclined guide portion in which its height is the lowest on the most downstream position of the auxiliary cam portion in the sheet-supply direction and becomes higher with being nearer to the most upstream position of auxiliary cam portion in the sheet-supply direction; a second guide portion continuous with the first inclined guide portion and having a substantially constant height; and a third guide portion continuous with the second guide portion and provided by a substantially V-shaped cutout portion.

According to the configuration of the auxiliary cam portion, when the first sheet tray 3 and the second sheet tray 30 are inserted together with each other into the housing 2 through the opening 2*a* formed in a front side of the housing 2, a lower surface of the cam follower member 45 comes into contact with the first inclined guide portion which is a rear end part of the auxiliary cam portion and which is nearer to the slant sheet-separator plate 8 over which the arm 40 and the first and second sheet-supply rollers 41, 42 are to be moved over. Further, with the movement of the second sheet tray 30 toward the slant sheet-separator plate 8, the cam follower member 45 is pushed upward, causing the arm 40, on which the first and second sheet-supply rollers 41, 42 are provided, to pivot upward together with the cam follower member 45. As a result, the arm 40 and the first and second sheet-supply rollers 41, 42 move or climb over the slant sheet-separator plate 8.

When the second guide portion is moved under the cam follower member 45 and the cam follower member 45 is positioned at a part of the third guide portion which inclines downward, the arm 40 on which the first and second sheet-supply rollers 41, 42 are provided and which is forced downward pivots downward accordingly. Thus, the second sheet-supply roller 42 can contact the uppermost one of the sheets P1 stacked on the bottom plate 30*a* or accommodated in the second sheet tray 30.

When the second sheet tray 30 is retracted from a position at which the first sheet tray 3 is advanced to a rear end portion in the housing 2 (a set state of the first sheet tray 3), the cam follower member 45 slides so as to contact the third guide portion, the second guide portion, and the first inclined guide portion in order. Then, the cam follower member 45 is disengaged from the one of the side plates 30*c* of the second sheet tray 30. Thus, in a state in which the bottom plate 30*a* of the second sheet tray 30 is retracted from the second sheet-supply roller 42 (i.e., at a non-sheet-supply position), the first sheet-supply roller 41 can contact a bottom portion of the first sheet tray 3, thereby allowing the sheet supplying operation by the first sheet-supply roller 41 to be performed.

As described above, the sheet-feed device 6 is provided with the cam follower member 45, and the second sheet tray 30 is provided with the auxiliary cam portion for pivoting the sheet-feed device 6, cooperating with the cam follower member 45, at least temporarily, such that the sheet-feed device 6 is raised and lowered in accordance with the advancing and retracting of the second sheet tray 30 with respect to the inside of the housing 2 (i.e., a casing). Thus, the sheet-feed device 6 can be automatically raised and lowered in accordance that the first sheet tray 3 and the second sheet tray 30 are integrally inserted into and removed from the housing 2, thereby facilitating an operation of a user. It is noted that one of side plates of the first sheet tray 3 may be provided with a main cam portion having a configuration similar to that of the above-described auxiliary cam portion. This configuration permits the first sheet-supply roller 41 of the arm 40 to move to the position above the height level of the slant sheet-separator plate 8 when the first sheet tray 3 is inserted into or removed from the housing 2.

Figure 7A:
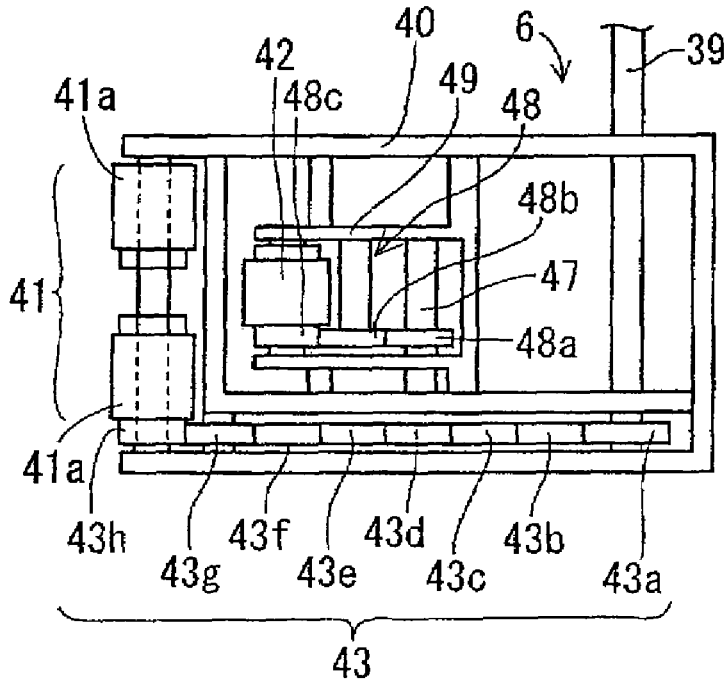
FIG. 7A is a plan view showing a sheet-feed device relating to a second embodiment.
Figure 7B:
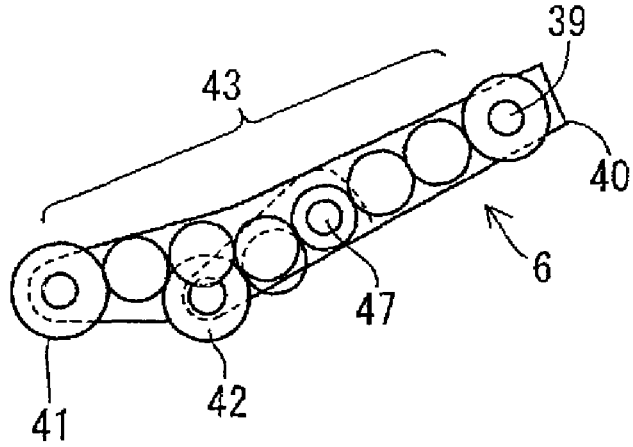
FIG. 7B is a general side view of the sheet-feed device relating to the second embodiment.

FIGS. 7A and 7B show a positional relationship and shapes of a first sheet-supply roller 41 and a second sheet-supply roller 42 provided on an arm 40 of an image recording apparatus 1 as a second embodiment. In this image recording apparatus 1, the first sheet-supply roller 41 constituted by a pair of sub-rollers 41*a* having the same shape is provided at a rear end portion of the arm 40 so as to be symmetrical in shape with respect to the plane that includes the center line of the sheets P in the widthwise direction thereof and that is perpendicular to the line extending in the widthwise direction. As a result, a contact portion of the first sheet-supply roller 41 which is constituted by two contact portions of the sub-rollers 41*a* is symmetrical in shape with respect to the plane that includes the center line of the sheets P in the widthwise direction thereof and that is perpendicular to the line extending in the widthwise direction. Similarly, a second sheet-supply roller 42 disposed at an intermediate portion of the arm 40 in a longitudinal direction thereof is symmetrical in shape with respect to the plane that includes the center line of the sheets P1 in the widthwise direction thereof and that is perpendicular to the line extending in the widthwise direction. As a result, a contact portion of the second sheet-supply roller 42 is symmetrical in shape with respect to the plane that includes the center line of the sheets P1 in the widthwise direction thereof and that is perpendicular to the line extending in the widthwise direction. In the frame-like arm 40, there is provided the rotation transmission mechanism 43 including the eight gears 43*a*, 43*b*, 43*c*, 43*d*, 43*e*, 43*f*, 43*g*, 43*h*, which are arranged in a row and each of which is meshed with corresponding adjacent one or two of the eight gears, so that a drive force is transmitted to the first sheet-supply roller 41. The drive force is transmitted to the second sheet-supply roller 42 via an auxiliary gear transmission mechanism 48 (i.e., a second transmission mechanism) including gears 48*a*, 48*b*, 48*c* and a transmission shaft 47 which is rotated integrally with the fourth gear 43*d* as counted from the first gear 43*a*. In this image recording apparatus 1 as the second embodiment, in the arm 40, the auxiliary arm portion 49 is formed integrally with the arm 40. The transmission shaft 47, the auxiliary gear transmission mechanism 48, and the second sheet-supply roller 42 are set on the auxiliary arm portion 49. It is noted that a diameter (and a number of teeth) of each of the gears of the rotation transmission mechanism 43 is the same as that of each of the gears of the auxiliary gear transmission mechanism 48, and thus the circumferential velocities of the respective contact portions of the first and second sheet-supply rollers 41, 42 are the same, where the first and second sheet-supply rollers 41, 42 have the same diameter.

Figure 8A:
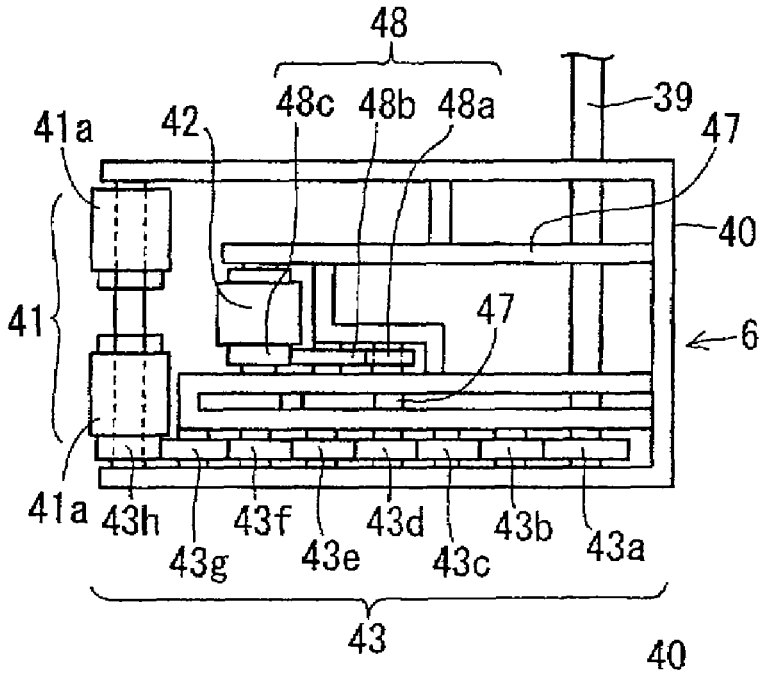
FIG. 8A is a plan view showing a sheet-feed device relating to a modification of the second embodiment.
Figure 8B:
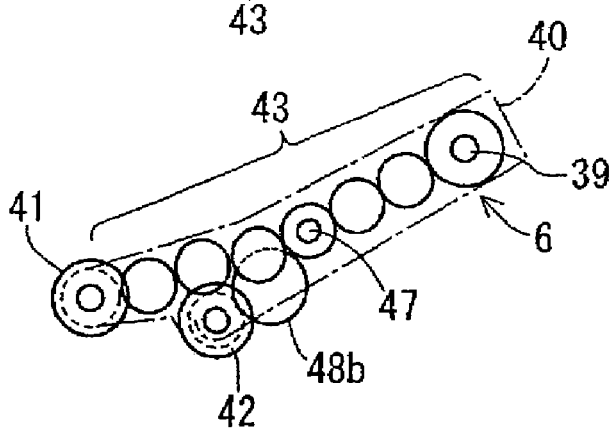
FIG. 8B is a general side view of the sheet-feed device relating to the modification of the second embodiment.

FIGS. 8A and 8B show a modification of the second embodiment. In this modification, the three gears 48*a*, 48*b*, 48*c* of the auxiliary gear transmission mechanism 48 have different diameters. More specifically, the diameter (and the number of teeth) of the gear 48*b* disposed between the other two gears is larger than that of the other two gears. Thus, the circumferential velocity of the first sheet-supply roller 41, that is, the circumferential velocity of the contact portion of the first sheet-supply roller 41, is higher than that of the second sheet-supply roller 42. The other construction of this modification is the same as that of the second embodiment. Thus, the reference numerals as used in the first embodiment are used to identify the corresponding components, and a detailed explanation of which is dispensed with.

Figure 9A:
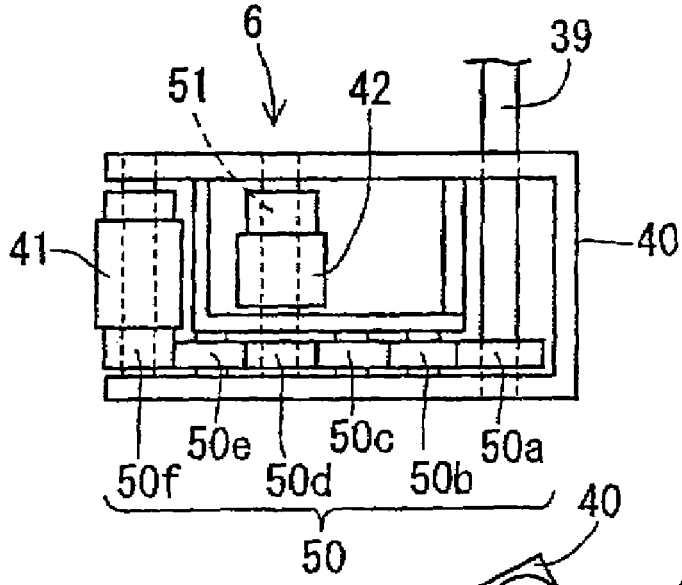
FIG. 9A is a plan view showing a sheet-feed device relating to a third embodiment.
Figure 9B:
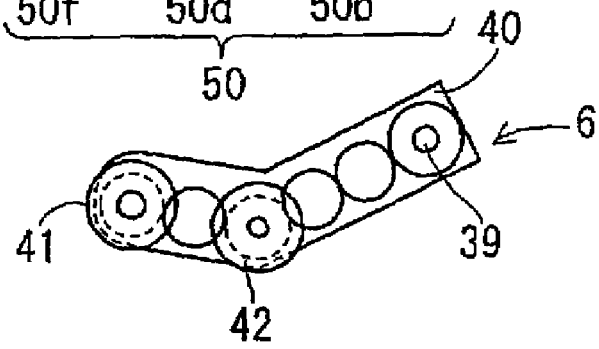
FIG. 9B is a general side view of the sheet-feed device relating to the third embodiment.

FIGS. 9A and 93B show an image recording apparatus 1 as a third embodiment. In this image recording apparatus 1, each of one first sheet-supply roller 41 and one second sheet-supply roller 42 is disposed so as to be symmetrical in shape with respect to the plane that includes the center line of the sheets P (P1) in the widthwise direction thereof and that is perpendicular to the line extending in the widthwise direction. As a result, a contact portion of each of the first sheet-supply roller 41 and the second sheet-supply roller 42 is also symmetrical in shape with respect to the plane that includes the center line of the sheets P (P1) in the widthwise direction thereof and that is perpendicular to the line extending in the widthwise direction. In a frame-like arm 40, a gear transmission mechanism 50 including six gears 50*a*, 50*b*, 50*c*, 50*d*, 50*e*, 50*f* arranged in a row is set on the arm 40. The second sheet-supply roller 42 is attached to a shaft 51 which is rotated integrally with the fourth gear 50*d* as counted from a gear located on the most upstream position in order in which the drive force is transmitted. In these configurations, the drive force is transmitted from the drive shaft 39 to the first and second sheet-supply rollers 41, 42. In this image recording apparatus 1, the transmission mechanism can be shorter, permitting the arm 40 to be shorter and more compact. It should be understood that the first and second sheet-supply rollers 41, 42 are set to be rotated in the same direction in the illustrated embodiments.

It is noted that, in the image recording apparatus 1 as each of the embodiments, a range of a movement of the first sheet-supply roller 41 (i.e., a range from the angle θ1 to the angle θ2) and a range of a movement of the second sheet-supply roller 42 (i.e., a range from the angle θ3 to the angle θ4) may be set to be similar to each other.

In the image recording apparatus 1 as each of the embodiments, the two sheet-supply rollers 41, 42 are arranged on and along the arm 40. In this configuration of the image recording apparatus 1, when the sheet P accommodated in the first sheet tray 3 is to be supplied, only the first sheet-supply roller 41 contacts the uppermost sheet P. When the sheet P1 accommodated in the second sheet tray 30 is supplied, only the second sheet-supply roller 42 contacts the uppermost sheet P1. Thus, even where recording sheets of different types from each other in e.g., sheet material, thickness, and size, are respectively accommodated in the first and second sheet trays 3, 30, the no-sheet feeding and the multi-sheets feeding can be prevented for the both types of the sheets, thereby allowing a reliable and stable sheet supplying operation and realizing an improved recording quality.

It is to be understood that the invention is not limited to the details of the illustrated embodiments, but may be embodied with various changes and modifications, which may occur to those skilled in the art, without departing from the spirit and scope of the invention. For example, the respective diameters of the first and second sheet-supply rollers 41, 42 may be set to be different from each other. Where the first and second sheet-supply rollers 41, 42 are thus configured, even where the recording sheets of different types from each other in e.g., sheet material, thickness, and size, are respectively accommodated in the first and second sheet trays 3, 30, each of the sheets of different types can be supplied by a corresponding one of the first and second sheet-supply rollers 41, 42 which has a circumference velocity suitable for each sheet. Thus, the no-sheet feeding and the multi-sheets feeding can be prevented, and the recording quality can be improved.

What is claimed is:

1. A recording-sheet supplying apparatus configured to supply recording sheets one by one in a predetermined sheet-supply direction, comprising:

a first sheet tray configured to accommodate a plurality of first recording sheets in a state in which the plurality of first recording sheets are stacked on each other;

a second sheet tray disposed above the first sheet tray so as to be advanced and retracted in the sheet-supply direction, and configured to accommodate at least one second recording sheet in a state in which, where the at least one second recording sheet is one, only the second recording sheet is accommodated in the second sheet tray, while where the at least one second recording sheet is plural, the second recording sheets are stacked on each other in the second sheet tray;

an arm provided so as to be pivotable about a pivot axis located above the second sheet tray, and so as to be in a posture in which a distal end of the arm is located downstream of the pivot axis in the sheet-supply direction;

a first sheet-supply roller provided at a first portion of the arm; and a second sheet-supply roller provided at a second portion of the arm nearer to the pivot axis than the first portion, wherein the recording-sheet supplying apparatus is configured such that, in a state in which the second sheet tray is retracted to be located on an upstream side in the sheet-supply direction, the arm is allowed to be pivoted below a height level of the second sheet tray, and the first sheet-supply roller contacts an uppermost one of the plurality of first recording sheets, whereby the plurality of first recording sheets are supplied one by one in order from the uppermost first recording sheet, and wherein the recording-sheet supplying apparatus is configured such that, in a state in which the second sheet tray is advanced to be located on a downstream side in the sheet-supply direction, the second sheet-supply roller contacts an uppermost one of the at least one second recording sheet, whereby the at least one second recording sheet is supplied one by one in order from the uppermost second recording sheet.

2. The recording-sheet supplying apparatus according to claim 1, further comprising a separating member disposed downstream of the first sheet tray and the second sheet tray in the sheet-supply direction, wherein the separating member is configured such that, when at least two of the plurality of first recording sheets which include the uppermost first recording sheet are likely to be supplied by the first sheet-supply roller while overlapping each other, downstream end portions of the at least two first recording sheets in the sheet-supply direction contact the separating member, whereby the separating member separates the uppermost first recording sheet from the other of the at least two of the plurality of first recording sheets, and wherein the separating member is configured such that, where the second sheet tray is configured to accommodate the plurality of second recording sheets, when at least two of the plurality of second recording sheets which include the uppermost second recording sheet are likely to be supplied by the second sheet-supply roller while overlapping each other, downstream end portions of the at least two second recording sheets in the sheet-supply direction contact the separating member, whereby the separating member separates the uppermost second recording sheet from the other of the at least two second recording sheets.

3. The recording-sheet supplying apparatus according to claim 1, wherein the first sheet-supply roller is disposed at a distal end portion, as the first portion, of the arm in a longitudinal direction thereof, and wherein the second sheet-supply roller is disposed at a portion, as the second portion, of the arm which is located intermediate between the pivot axis and the distal end portion, in the longitudinal direction of the arm.

4. The recording-sheet supplying apparatus according to claim 1, wherein positions of the first portion and the second portion of the arm at which the first sheet-supply roller and the second sheet-supply roller are respectively provided are set such that when the plurality of first recording sheets accommodated in the first sheet tray are to be supplied, a state is realized in which the first sheet-supply roller contacts the uppermost first recording sheet while the second sheet-supply roller is located above the uppermost first recording sheet, and such that when the at least one second recording sheet accommodated in the second sheet tray is to be supplied, a state is realized in which the second sheet-supply roller contacts the uppermost second recording sheet while the first sheet-supply roller is located above the uppermost second recording sheet.

5. The recording-sheet supplying apparatus according to claim 1, further comprising a drive shaft which is rotated to drive the first sheet-supply roller and the second sheet-supply roller.

6. The recording-sheet supplying apparatus according to claim 5, wherein an axis of the drive shaft coincides with the pivot axis, and wherein the arm is pivotably supported by the drive shaft.

7. The recording-sheet supplying apparatus according to claim 5, further comprising a rotation transmission mechanism which transmits a rotation of the drive shaft to the first sheet-supply roller and the second sheet-supply roller.

8. The recording-sheet supplying apparatus according to claim 7, wherein the rotation transmission mechanism is configured such that the first sheet-supply roller and the second sheet-supply roller are rotated in the same direction by the rotation of the drive shaft in one direction.

9. The recording-sheet supplying apparatus according to claim 7, wherein the first sheet-supply roller includes a contact portion which contacts the uppermost first recording sheet, and the second sheet-supply roller includes a contact portion which contacts the uppermost second recording sheet, and wherein the rotation transmission mechanism and diameters of the respective contact portions of the first sheet-supply roller and the second sheet-supply roller are designed such that a circumferential velocity of the contact portion of the first sheet-supply roller is higher than that of the contacting portion of the second sheet-supply roller.

10. The recording-sheet supplying apparatus according to claim 9, wherein the diameters of the respective contact portions of the first sheet-supply roller and the second sheet-supply roller are the same.

11. The recording-sheet supplying apparatus according to claim 1, wherein the first sheet-supply roller includes a contact portion which contacts the uppermost first recording sheet, and the second sheet-supply roller includes a contact portion which contacts the uppermost second recording sheet, wherein the contact portion of the first sheet-supply roller is symmetrical in shape with respect to a plane that includes a center line of the uppermost first recording sheet in a widthwise direction thereof and that is perpendicular to a line extending in the widthwise direction, and wherein the contact portion of the second sheet-supply roller is symmetrical in shape with respect to a plane that includes a center line of the uppermost second recording sheet in a widthwise direction thereof and that is perpendicular to a line extending in the widthwise direction.

12. The recording-sheet supplying apparatus according to claim 1, wherein the first sheet tray is configured to accommodate the plurality of first recording sheets substantially horizontally, and wherein the second sheet tray is configured to accommodate the at least one second recording sheet substantially horizontally.

13. The recording-sheet supplying apparatus according to claim 1, wherein the second sheet tray is disposed above the first sheet tray such that a prescribed space is provided, in a vertical direction, between the uppermost first recording sheet and a lowermost one of the at least one second recording sheet.

14. An image recording apparatus comprising:

the recording-sheet supplying apparatus according to claim 1; and an image recording section that records an image on each of the plurality of first recording sheets and each of the at least one second recording sheet which are supplied by the recording-sheet supplying apparatus.

* * * * *